US011359271B2

(12) United States Patent
Shimizu et al.

(10) Patent No.: US 11,359,271 B2
(45) Date of Patent: Jun. 14, 2022

(54) NITRIDING TREATMENT METHOD OF STEEL MEMBER

(71) Applicant: DOWA THERMOTECH CO., LTD., Tokyo (JP)

(72) Inventors: Yuichiro Shimizu, Sizuoka (JP); Katsushige Shimizu, Aichi (JP); Kiyotaka Akimoto, Tokyo (JP)

(73) Assignee: DOWA THERMOTECH CO., LTD., Tokyo (JP)

( * ) Notice: Subject to any disclaimer, the term of this patent is extended or adjusted under 35 U.S.C. 154(b) by 1085 days.

(21) Appl. No.: 15/561,286

(22) PCT Filed: Mar. 31, 2016

(86) PCT No.: PCT/JP2016/060657

§ 371 (c)(1),
(2) Date: Sep. 25, 2017

(87) PCT Pub. No.: WO2016/159235

PCT Pub. Date: Oct. 6, 2016

(65) Prior Publication Data

US 2018/0127863 A1 May 10, 2018

(30) Foreign Application Priority Data

Mar. 31, 2015 (JP) ..... JP2015-074275

(51) Int. Cl.

| | |
|---|---|
| ***C23C 8/26*** | (2006.01) |
| ***C23C 8/80*** | (2006.01) |
| ***C21D 1/06*** | (2006.01) |
| ***C22C 38/04*** | (2006.01) |
| ***C22C 38/24*** | (2006.01) |
| ***C22C 38/02*** | (2006.01) |

(Continued)

(52) U.S. Cl.
CPC ..... *C23C 8/26* (2013.01); *C22C 38/02* (2013.01); *C22C 38/04* (2013.01); *C22C 38/06* (2013.01);

(Continued)

(58) Field of Classification Search
None
See application file for complete search history.

(56) References Cited

U.S. PATENT DOCUMENTS

| | | | | |
|---|---|---|---|---|
| 10,385,439 | B2 * | 8/2019 | Shimizu | C21D 9/0056 |
| 2012/0048427 | A1 | 3/2012 | Kubota | |
| 2015/0053311 | A1 | 2/2015 | Shimizu et al. | |

FOREIGN PATENT DOCUMENTS

| | | | |
|---|---|---|---|
| CN | 102421927 | A | 4/2012 |
| CN | 104334766 | A | 2/2015 |

(Continued)

OTHER PUBLICATIONS

Liedtke et al., "Nitriding and Nitrocarburizing on Iron Materials", 1st edition 1st print, AGNE Gijutsu Center Inc., Aug. 30, 2011, pp. 11, 12, 37 to 39, 131 to 133, 136, 137.

(Continued)

*Primary Examiner* — Anthony M Liang
(74) *Attorney, Agent, or Firm* — Greenblum & Bernstein, P.L.C.

(57) ABSTRACT

A nitriding treatment method of a steel member, in which a nitriding treatment step is performed in which the steel member is subjected to a nitriding treatment in a nitriding gas atmosphere having a nitriding potential with which a γ' phase or ε phase iron nitride compound layer is generated on a surface of the steel member, and then, a passing step is performed in which the steel member is made to pass through an atmosphere at 425° C. to 600° C. where the iron nitride compound layer does not grow over five minutes or more, the iron nitride compound layer has the γ' phase uppermost surface layer, and the γ' phase is made to precipitate in the iron nitride compound layer by the proportion of 40% or more.

5 Claims, 5 Drawing Sheets

| | | NITRIDING TREATMENT STEP | | | PASSING STEP | | |
|---|---|---|---|---|---|---|---|
| | UNIT | TEMPERATURE INCREASING | NITRIDING | COOLING | TEMPERATURE INCREASING | PASSING | COOLING |
| FURNACE TEMPERATURE | ℃ | 600 | 600 | COOLING CHAMBER | | T | COOLING CHAMBER |
| TIME | min | | 45 | 20 | | t | 20 |
| | | | | | | | |
| $N_2$ | L/min | 25 | 25 | 84 | 50 | 50 | 84 |
| $NH_3$ | L/min | 25 | 25 | - | 0 | 0 | - |
| $H_2$ | L/min | 0 | 0 | - | 0 | 0 | - |
| Air | L/min | 1.8 | 1.8 | - | 0 | 0 | - |
| KN IN FURNACE | - | - | 0.65 | - | - | - | - |

(51) Int. Cl.

| | |
|---|---|
| ***C22C 38/22*** | (2006.01) |
| ***C22C 38/18*** | (2006.01) |
| ***C22C 38/06*** | (2006.01) |
| *C21D 9/32* | (2006.01) |

(52) U.S. Cl.
CPC ..... *C22C 38/18* (2013.01); *C22C 38/22* (2013.01); *C22C 38/24* (2013.01); *C23C 8/80* (2013.01); *C21D 1/06* (2013.01); *C21D 9/32* (2013.01)

(56) References Cited

FOREIGN PATENT DOCUMENTS

| | | | | |
|---|---|---|---|---|
| JP | S53001142 | A | 1/1978 | |
| JP | H05070925 | A | 3/1993 | |
| JP | H11072159 | A | 3/1999 | |
| JP | H11124653 | A | 5/1999 | |
| JP | 2002241922 | A | 8/2002 | |
| JP | 5669979 | B1 | 2/2015 | |
| WO | 2013157579 | A1 | 10/2013 | |
| WO | WO-2016024923 | A1 * | 2/2016 | ..... C23C 8/34 |

OTHER PUBLICATIONS

International Search Report from Patent Application No. PCT/JP2016/060657, dated Jun. 14, 2016.

Yingjun et al., "Application of Plasma Technology to Material", 6.1 Structure of Nitrided Layer, p. 90, Hubei Science and Technology Press, Jun. 2003.

Office Action issued in CN 201680019600.X, dated Jul. 23, 2018, with partial English translation.

* cited by examiner

| | | NITRIDING TREATMENT STEP | | | PASSING STEP | | |
|---|---|---|---|---|---|---|---|
| | UNIT | TEMPERATURE INCREASING | NITRIDING | COOLING | TEMPERATURE INCREASING | PASSING | COOLING |
| FURNACE TEMPERATURE | ℃ | 600 | 600 | COOLING CHAMBER | | T | COOLING CHAMBER |
| TIME | min | | 45 | 20 | | t | 20 |
| | | | | | | | |
| $N_2$ | L/min | 25 | 25 | 84 | 50 | 50 | 84 |
| $NH_3$ | L/min | 25 | 25 | - | 0 | 0 | - |
| $H_2$ | L/min | 0 | 0 | - | 0 | 0 | - |
| Air | L/min | 1. 8 | 1. 8 | - | 0 | 0 | - |
| KN IN FURNACE | - | - | 0. 65 | - | - | - | - |

NITRIDING TREATMENT METHOD OF STEEL MEMBER

TECHNICAL FIELD

The present invention relates to a method of nitriding a surface of a steel member in a gas atmosphere.

BACKGROUND ART

Gears to be used in, for example, automobile transmissions are required to be high in pitting resistance and bending fatigue strength. In order to meet such a requirement, a carburizing treatment has been performed widely as a method to strengthen a steel member such as a gear conventionally. Further, in order to achieve a further improvement in pitting resistance, there has been proposed an invention relating to increasing strength by a carbonitriding treatment (Patent Document 1). On the other hand, with regard to a planetary gear, due to its engagement degree being high, tooth profile accuracy (strain) has a great effect on gear noise. There has been a problem that an internal gear in particular is likely to be strained due to being thin and large in diameter. Thus, there has been also proposed an invention relating to a gas nitrocarburizing treatment causing a steel member to strain little and further causing a small strain variation (Patent Document 2). Further, the present applicant has disclosed an invention relating to a low-strain and high-strength nitrided steel member (Patent Document 3).

PRIOR ART DOCUMENT

Patent Document

[Patent Document 1] Japanese Laid-open Patent Publication No. H5-70925

[Patent Document 2] Japanese Laid-open Patent Publication No. H11-72159

[Patent Document 3] International Publication No. 2013/157579

DISCLOSURE OF THE INVENTION

Problems to be Solved by the Invention

A steel member whose strength is increased by a gas nitrocarburizing treatment is small in strain amount and strain variation, but is inferior in pitting resistance and fatigue strength such as bending fatigue strength as compared to a steel member whose strength is increased by carburizing or carbonitriding.

Further, a high-strength carbonitrided member produced by the carbonitriding described in Patent Document 1 has a problem of low bending fatigue strength even though its pitting resistance is higher than that of a carburized member. It also has a problem that a strain amount is increased because it is heat-treated in an austenite transformation temperature range of steel. Further, it has a problem that strain variation is large in a lot and among lots because a quenching process is essential for carburizing and carbonitriding treatments.

Further, in a nitrided member having undergone the gas nitrocarburizing treatment described in Patent Document 2 or the like, by thinning a compound layer, pitting resistance (difficulty that the compound layer on the uppermost surface peels off) is improved as compared to a compound layer obtained by a conventional gas nitrocarburizing treatment, but is inferior as compared to one having undergone a carburizing treatment.

On the other hand, the nitrided member having undergone a gas nitrocarburizing treatment described in Patent Document 3 has the advantage of having low strain and high pitting resistance and bending fatigue strength by having a nitride compound layer whose main component is a γ' phase on a surface of the steel member (base metal) having a predetermined composition. However, obtaining the γ' phase-rich nitride compound layer requires a high ratio of a partial pressure of $H_2$ gas, resulting in an increase in cost. Further, it is sometimes necessary to optimize a ratio of a partial pressure of $NH_3$ gas and a ratio of a partial pressure of $H_2$ gas in a furnace and a wind velocity in a furnace depending on a steel type. Further, it is necessary to perform a long-term nitriding treatment with a low nitriding potential KN in order to obtain a main component composed of the γ' phase.

An object of the present invention is to provide a nitriding treatment method of a steel member that does not require optimization of ratios of partial pressures of $NH_3$ gas and $H_2$ gas and a wind velocity depending on a steel type and is capable of easily forming the γ' phase-rich nitride compound layer at a low ratio of a partial pressure of $H_2$ gas.

Means for Solving the Problems

As a result of earnest examination for solving the above-described problems, the present inventors found out that a nitriding treatment step is performed in which a steel member is subjected to a nitriding treatment in a nitriding gas atmosphere having a relatively high nitriding potential, and then a passing step is performed in which the steel member is made to pass through an atmosphere at 425° C. to 600° C. where an iron nitride compound layer does not grow over five minutes or more, thereby making it possible to form a γ' phase-rich iron nitride compound layer for a short period of time even at a low ratio of a partial pressure of $H_2$ gas, and reached completion of the present invention.

According to the present invention, there is provided a nitriding treatment method of a steel member in which a nitriding treatment step is performed in which the steel member is subjected to a nitriding treatment in a nitriding gas atmosphere having a nitriding potential with which a γ' phase or ε phase iron nitride compound layer is generated on a surface of the steel member, and then a passing step is performed in which the steel member is made to pass through an atmosphere at 425° C. to 600° C. where the iron nitride compound layer does not grow over five minutes or more, the iron nitride compound layer has the γ' phase uppermost surface layer, and the γ' phase is made to precipitate in the iron nitride compound layer by the proportion of 40% or more.

Further, according to the present invention, there is provided a nitriding treatment method of a steel member in which a nitriding treatment step is performed in which the steel member is subjected to a nitriding treatment in a nitriding gas atmosphere having a nitriding potential with which a γ' phase or ε phase iron nitride compound layer is generated on a surface of the steel member, and then a passing step is performed in which the steel member is made to pass through an atmosphere containing one or more of nitrogen, Ar, and H2 at 425° C. to 600° C. over five minutes or more, the iron nitride compound layer has the γ' phase uppermost surface layer, and the γ' phase is made to precipitate in the iron nitride compound layer by the proportion of 40% or more.

Furthermore, according to the present invention, there is provided a nitriding treatment method of a steel member in which a nitriding treatment step is performed in which the steel member is subjected to a nitriding treatment in a nitriding gas atmosphere having a nitriding potential with which a γ' phase or ε phase iron nitride compound layer is generated on a surface of the steel member, and then a passing step is performed in which the steel member is made to pass through a nitridation gas atmosphere having the nitriding potential with which the γ' phase or s phase iron nitride compound layer is not generated at 425° C. to 600° C. over five minutes or more, the iron nitride compound layer has the γ' phase uppermost surface layer, and the γ' phase is made to precipitate in the iron nitride compound layer by the proportion of 40% or more.

Effect of the Invention

According to the present invention, it becomes possible to form a γ' phase-rich iron nitride compound layer at a low ratio of a partial pressure of $H_2$ gas for a short period of time. A steel member nitrided by the present invention has excellent pitting resistance and bending fatigue strength, which are nearly equivalent to those of a carburized member, and is low in strain as compared to one having undergone the carburizing or carbonitriding treatment.

MODE FOR CARRYING OUT THE INVENTION

Hereinafter, the present invention will be explained in detail with reference to the drawings.

Components of a steel member (base metal) to be nitrided by the present invention are not limited in particular. Examples of steel types to be nitrided include S25C, S35C, S34C, SCM415, SCM420, SCM435, SACM645, and so on.

A later-described nitriding treatment is performed on such a steel member, thereby making it possible to have a γ' phase uppermost surface layer of an iron nitride compound layer and precipitate the γ' phase in the iron nitride compound layer by the proportion of 40% or more, resulting in that it becomes possible to obtain a steel member having excellent pitting resistance and bending fatigue strength.

Incidentally, in the present invention, the "iron nitride compound layer" refers to a layer composed of an iron nitride compound typified by γ' phase-$Fe_4N$ or ε phase-$Fe_{2-3}N$ formed on a surface of the steel member by the nitriding treatment. The iron nitride compound layer is the γ' phase or the F phase, and is formed on the surface of the steel member in a layer state. In the present invention, it is possible to generate, on the surface of the steel member (base metal), an iron nitride compound layer containing the γ' phase precipitated therein by the proportion of 40% or more and have the γ' phase uppermost surface layer of the iron nitride compound layer.

In the present invention, a nitriding treatment step is performed in which the steel member is subjected to a nitriding treatment in a nitriding gas atmosphere having a relatively high nitriding potential, and then a passing step is performed in which the steel member is made to pass through an atmosphere at 425° C. to 600° C. where an iron nitride compound layer does not grow over five minutes or more, to thereby form a nitride compound layer having, as its main component, a γ' phase on a surface. The thickness of the iron nitride compound layer is, for example, 2 to 30 μm. The thickness of the iron nitride compound layer being less than 2 μm is too thin, and thus it is thought that an improvement in fatigue strength is restrictive.

The reason why the pitting resistance and the bending fatigue strength of the steel member nitrided by the present invention are excellent is thought as follows. The γ' phase crystal structure is a FCC (face-centered cubic) and has 12 slip systems, and thus the crystal structure itself is rich in toughness. Further, a fine equiaxed structure is formed, and thus the fatigue strength is thought to improve. Contrary to this, an ε phase crystal structure is a HCP (hexagonal close-packed structure), and basal sliding is preferential, and thus the crystal structure itself is thought to have a property of "being not easily deformed and being brittle." Further, the ε phase forms coarse columnar crystals and has a structure form disadvantageous for the fatigue strength.

Figures 1, 2:
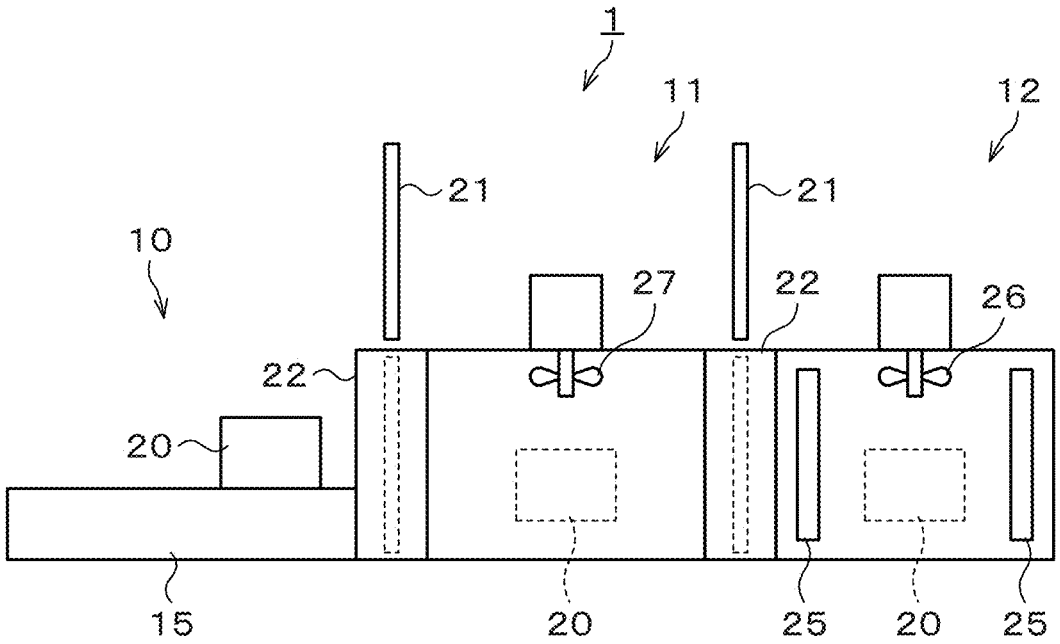
FIG. 1 is an explanatory view of a heat treatment apparatus.
FIG. 2 is an explanatory process chart of a nitriding treatment method.

Here, the nitriding treatment in the nitriding gas atmosphere, which is performed on the steel member by the present invention, is performed using a heat treatment apparatus (air atmosphere nitriding furnace) 1 illustrated in FIG. 1, for example. As illustrated in FIG. 1, the heat treatment apparatus 1 has a loading part 10, a cooling chamber 11, and a heating chamber 12. In a case 20 to be carried into the loading part 10 by a conveyor 15, the steel member is housed. The steel member is a gear or the like used in an automatic transmission, for example.

Each hood 22 including a door 21 that rises and falls easily is attached between the loading part 10 and the cooling chamber 11 and between the cooling chamber 11 and the heating chamber 12. When the doors 21 rise, a communicating state is made between the loading part 10 and the cooling chamber 11 and between the cooling chamber 11 and the heating chamber 12, and when the doors 21 fall, a closed state is made between the loading part 10 and the cooling chamber 11 and between the cooling chamber 11 and the heating chamber 12.

Heaters 25 are provided in the heating chamber 12. A nitriding treatment gas composed of $N_2$ gas, $NH_3$ gas, the air, and the like is introduced into the heating chamber 12, the nitriding treatment gas introduced into the heating chamber 12 is heated to a predetermined temperature by the heaters 25, and the steel member carried into the heating chamber 12 is subjected to the nitriding treatment. A fan 26 for stirring the treatment gas in the heating chamber 12, keeping the heating temperature of the steel member uniform, and controlling a wind velocity of the treatment gas that hits against the steel member is fitted in a ceiling of the heating chamber 12.

A cooling gas such as an $N_2$ gas is introduced into the cooling chamber 11, and the steel member carried into the cooling chamber 11 is cooled. A fan 27 for stirring the cooling gas in the cooling chamber 11, keeping the cooling temperature of the steel member uniform, and controlling a wind velocity of the cooling gas that hits against the steel member is fitted in a ceiling of the cooling chamber 11.

In the above-described heat treatment apparatus 1, the case 20 housing the steel member is sequentially loaded into the heating chamber 12 and then into the cooling chamber 11 from the loading part 10 by a pusher or the like. Then, in the heat treatment apparatus 1, a nitriding treatment step is performed in which the steel member is subjected to a nitriding treatment in a nitriding gas atmosphere having a predetermined nitriding potential, and then a passing step is performed in which the steel member is made to pass through a nitrogen-containing atmosphere at 425° C. to 600° C. over five minutes or more, thereby making it possible to obtain a steel member including an iron nitride compound layer whose uppermost surface layer (layer having a 1 μm thickness from the surface of the iron nitride compound layer) is the γ' phase and in which the γ' phase is precipitated by the proportion of 40% or more. Incidentally, prior to the nitriding treatment, cleaning (a pre-treatment) for removing contaminants and oil of a member to be treated (the steel member) is preferably performed. For example, vacuum cleaning that degreases and dries the member to be treated by melting and replacing the oil and so on by a hydrocarbon-based cleaning liquid and evaporating the oil and so on, alkali cleaning that performs a degreasing treatment by an alkali cleaning liquid, or the like is preferred.

<Nitriding Treatment Step>

The nitriding treatment step is performed by temperature increasing, nitriding, and cooling, which are explained below, for example.

(Temperature Increasing)

When the steel member is loaded into the heating chamber 12, for example, as illustrated in FIG. 2, a $N_2$ gas at 25 liter/min, a $NH_3$ gas at 25 liter/min, and the air at 1.8 liter/min are first introduced into the heating chamber 12 and heated by the heaters 25, and the steel member is heated up to a nitriding treatment temperature of 600° C. In this temperature increasing, it is not necessary to precisely control the atmosphere as long as extreme oxidation of the steel member can be prevented during the heating, and in an atmosphere of $N_2$ or Ar being an inert gas, for example, the heating may be performed. Alternatively, an appropriate amount of the $NH_3$ gas or the like may be mixed as described above to produce a reducing atmosphere.

(Nitriding)

Then, when the steel member is heated up to a predetermined nitriding treatment temperature (for example, 600° C.), the $N_2$ gas at 25 liter/min, the $NH_3$ gas at 25 liter/min, and the air at 1.8 liter/min are continuously introduced into the heating chamber 12 so as to have a predetermined nitriding treatment gas composition and heated by the heaters 25, followed by soaking to 600° C. for 45 minutes, for example, and then nitriding of the steel member is performed. While the nitriding is being performed, a partial pressure of the $NH_3$ gas and a partial pressure of the $H_2$ gas in the heating chamber 12 are each controlled to fall within a predetermined range to be kept to a nitriding potential KN with which the γ' phase or ε phase iron nitride compound layer is generated on the surface of the steel member.

While the nitriding is being performed, the heating temperature of the steel member is preferably kept at 500 to 620° C. When the temperature is higher than 620° C., softening of the steel member, and an increase in strain may occur, and when the temperature is lower than 500° C., a formation speed of the iron nitride compound layer becomes slow, which is not preferable in view of cost, and the s phase becomes likely to be formed. It is more preferably 550 to 610° C.

While the nitriding is being performed, controlling the partial pressure of the $NH_3$ gas and the partial pressure of the $H_2$ gas enables the nitriding potential KN in the heating chamber 12 to be kept to 0.25 or more, for example. When the nitriding potential KN is lower than 0.25, a generation speed of the iron nitride compound may become extremely slow, or the iron nitride compound may not be generated. Incidentally, the atmosphere while the nitriding is being performed may be a reduced pressure atmosphere or a pressurized atmosphere. However, in view of manufacturing cost and handlability of the heat treatment apparatus, the pressure in the heating chamber 12 is preferably a substantially atmospheric pressure, for example, 0.092 to 0.11 MPa.

The thickness of the iron nitride compound can be controlled in the nitriding treatment gas atmosphere by the time and the temperature. That is, the longer time increases the thickness of the iron nitride compound, and the higher temperature increases the generation speed of the iron nitride compound. Incidentally, the nitriding time desirably falls within a range of greater than 0.5 hours and less than 10 hours.

While the nitriding is being performed, the nitriding gas hits against the steel member by the fan 26 or the like in the heating chamber 12.

(Cooling)

Then, after the nitriding is finished, the case 20 housing the steel member is carried into the cooling chamber 11. Then, the $N_2$ gas at 84 liter/min is introduced into the cooling chamber 11, and cooling of the steel member is performed for 20 minutes, for example. While the cooling is being performed, the gas is stirred by the fan 27 or the like in the cooling chamber 11 to increase cooling efficiency.

<Passing Step>

Then, the passing step is performed by temperature increasing, passing, and cooling, which are explained below, for example.

(Temperature Increasing)

When the steel member once cooled in the cooling chamber 11 in the previously described nitriding treatment step is loaded into the heating chamber 12 again, as illustrated in FIG. 2, for example, the $N_2$ gas at 50 liter/min is introduced into the heating chamber 12 and heated by the heaters 25, and the steel member is heated up to a predetermined passing temperature T° C. In this temperature increasing, it is not necessary to strictly control the atmosphere as long as extreme oxidation of the steel member can be prevented during the heating, and in an atmosphere of Ar being an inert gas, for example, the heating may be performed.

(Passing)

Then, when the steel member is heated up to the predetermined temperature T° C., the $N_2$ gas at 50 liter/min is continuously introduced into the heating chamber 12 and heated by the heaters 25, followed by soaking to T° C. for a predetermined passing time t, and temperature passing of the steel member is performed. While this temperature passing is being performed, it becomes possible that carbonitrides present on the surface of the steel member are decarburized, a proportion of the γ' phase being a low-temperature stable phase increases in the iron nitride compound layer, the γ' phase uppermost surface layer of the iron nitride compound layer is obtained, and the γ' phase is made to precipitate in the iron nitride compound layer by the proportion of 40% or more. In this temperature passing, it is not necessary to strictly control the atmosphere as long as extreme oxidation of the steel member can be prevented, and, for example, appropriate amounts of Ar being an inert gas, reducing $H_2$, $NH_3$ gas being a nitridation gas, and the like, in addition to nitrogen, may be mixed.

While this temperature passing is being performed, the temperature T° C. of the steel member is made to fall within a range of 425 to 600° C., and the steel member is made to pass through an atmosphere where the iron nitride compound layer does not grow over five minutes or more. When the temperature is lower than 425° C., a decarburization speed is slow and thus efficiency is poor, and when the temperature is higher than 600° C., denitrification is promoted, an αFe uppermost surface layer is made, and a decrease in strength is concerned. For example, even when gradual cooling or soaking (450 to 600° C.) in a second soaking chamber is performed and the steel member continuously passes through a temperature range of 600 to 450° C. after performing the nitriding at 600° C., the effect of the invention can be obtained. The temperature T° C. is more preferably 450 to 550° C. Further, this temperature passing is desirably performed for about 15 to 60 minutes. The atmosphere where the iron nitride compound layer does not grow in the case of using the $NH_3$ gas or the like, which is a nitridation gas, means a region in which the γ' phase or the ε phase is not generated in the Lehrer diagram, which is known as an equilibrium diagram indicating a phase to be generated at an iron-nitrogen binary system temperature and with a nitriding potential.

(Cooling)

Then, after the temperature passing is finished, the case 20 housing the steel member is carried into the cooling chamber 11 again. Then, the $N_2$ gas at 84 liter/min is introduced into the cooling chamber 11 and cooling of the steel member is performed for 20 minutes, for example. While the cooling is being performed, the gas is stirred by the fan 27 or the like in the cooling chamber 11 to increase cooling efficiency.

When the nitriding treatment step and the passing step are finished as above, the case 20 housing the steel member is carried out to the loading part 10 to be mounted on the conveyor 15. In this manner, the nitriding treatment is finished. Incidentally, the coolings performed in the nitriding treatment step and the passing step may be performed by a method such as not only the air cooling or gas cooling, but also water cooling or oil cooling. Further, the atmosphere during which the nitriding treatment step and the passing step are performed may be a reduced pressure or pressurized atmosphere.

By the nitriding treatment being performed under the above condition, it is possible to obtain a nitrided steel member having, on its surface, the iron nitride compound layer whose main component is the γ' phase. The steel member thus obtained has sufficient pitting resistance and bending fatigue strength with the γ' phase-rich iron nitride compound layer being formed on the surface and the γ' phase uppermost surface layer being obtained.

Further, as compared to the carburizing or carbonitriding treatment, the nitriding treatment of the present invention causes only a small strain amount since it is a treatment at an austenite transformation temperature or less. Further, since a quenching step indispensable in the carburizing and carbonitriding treatments can be dispensed with, a strain variation amount is also smaller. As a result, it is possible to obtain a low-strain nitrided steel member low in strain and high in strength.

Further, fatigue strength is thought to be governed by the composition (the γ' phase or the ε phase) of the iron nitride compound layer formed on the surface of the member, hardness of the iron nitride compound layer, and hardness of the base metal immediately thereunder. Hereinafter, examples will be presented.

EXAMPLES

Examples 1 to 15, Comparative Examples 1 to 8

Samples (Steel type HSRG2) illustrated in Table 1 were prepared. These samples (Steel type HSRG2) were each subjected to a nitriding treatment step and a passing step under the conditions illustrated in Table 2, to thereby obtain respective nitrided steel members.

TABLE 1

| STEEL MATERIAL | C | Si | Mn | P | S | Cr | Mo | Fe |
|---|---|---|---|---|---|---|---|---|
| HSRG2 | 0.095 | 0.2 | 0.9 | | | 1.4 | | BALANCE |

TABLE 2

| | NITRADING | | | | | | | | | COOLING | | PASSING | | | COOLING | | IRON NITRADE COMPOUND LAYER | | |
|---|---|---|---|---|---|---|---|---|---|---|---|---|---|---|---|---|---|---|---|
| | TEMPER-ATURE (° C.) | TIME (min) | KN | NH3 FLOW RATE (L/mn) | H2 FLOW RATE (L/min) | Air FLOW RATE (L/min) | NH3 PARTIAL PRESSURE (vol %) | H2 PARTIAL PRESSURE (vol. %) | DEW POINT (° C.) | COOL-ING TIME (min) | N2 FLOW RATE (L/min) | TEMPER-ATURE (° C.) | TIME (min) | N2 FLOW RATE (L/min) | COOL-ING TIME (min) | N2 FLOW RATE (L/min) | THICK-NESS (μm) | γ' FRAC-TION (%) | DETERMI-NATION |
| COMPARATIVE EXAMPLE 1 | 600 | 45 | 0.64 | 28 | 22 | 1.8 | 32 | 63.2 | 16.9 | 20 | 84 | — | — | — | — | — | 11.5 | 21.3 | X |
| EXAMPLE 1 | 600 | 45 | 0.64 | 28 | 22 | 1.8 | 32 | 63.2 | 16.9 | 20 | 84 | 600 | 60 | 50 | 20 | 84 | 9.0 | 44.5 | ○ |
| EXAMPLE 2 | 600 | 45 | 0.64 | 28 | 22 | 1.8 | 32 | 63.2 | 16.9 | 20 | 84 | 600 | 30 | 50 | 20 | 84 | 10.2 | 47.8 | ○ |
| EXAMPLE 3 | 600 | 45 | 0.64 | 28 | 22 | 1.8 | 32 | 63.2 | 16.9 | 20 | 84 | 600 | 15 | 50 | 20 | 84 | 10.6 | 57.6 | ○ |
| EXAMPLE 4 | 600 | 45 | 0.64 | 28 | 22 | 1.8 | 32 | 63.2 | 16.9 | 20 | 84 | 575 | 60 | 50 | 20 | 84 | 11.0 | 56.7 | ○ |
| EXAMPLE 5 | 600 | 45 | 0.64 | 28 | 22 | 1.8 | 32 | 63.2 | 16.9 | 20 | 84 | 550 | 60 | 50 | 20 | 84 | 9.5 | 81.7 | ◎ |
| EXAMPLE 6 | 600 | 45 | 0.64 | 28 | 22 | 1.8 | 32 | 63.2 | 16.9 | 20 | 84 | 550 | 30 | 50 | 20 | 84 | 9.8 | 80.0 | ◎ |
| EXAMPLE 7 | 600 | 45 | 0.64 | 28 | 22 | 1.8 | 32 | 63.2 | 16.9 | 20 | 84 | 550 | 15 | 50 | 20 | 84 | 11.0 | 70.3 | ◎ |
| EXAMPLE 8 | 600 | 45 | 0.64 | 28 | 22 | 1.8 | 32 | 63.2 | 16.9 | 20 | 84 | 525 | 60 | 50 | 20 | 84 | 9.0 | 81.3 | ◎ |
| EXAMPLE 9 | 600 | 45 | 0.64 | 28 | 22 | 1.8 | 32 | 63.2 | 16.9 | 20 | 84 | 500 | 60 | 50 | 20 | 84 | 12.5 | 77.8 | ◎ |
| EXAMPLE 10 | 600 | 45 | 0.64 | 28 | 22 | 1.8 | 32 | 63.2 | 16.9 | 20 | 84 | 500 | 30 | 50 | 20 | 84 | 9.8 | 79.3 | ◎ |
| EXAMPLE 11 | 600 | 45 | 0.64 | 28 | 22 | 1.8 | 32 | 63.2 | 16.9 | 20 | 84 | 500 | 15 | 50 | 20 | 84 | 9.0 | 70.3 | ◎ |
| EXAMPLE 12 | 600 | 45 | 0.64 | 28 | 22 | 1.8 | 32 | 63.2 | 16.9 | 20 | 84 | 450 | 60 | 50 | 20 | 84 | 11.0 | 71.6 | ◎ |
| EXAMPLE 13 | 600 | 45 | 0.64 | 28 | 22 | 1.8 | 32 | 63.2 | 16.9 | 20 | 84 | 450 | 30 | 50 | 20 | 84 | 10.3 | 68.8 | ○ |
| EXAMPLE 14 | 600 | 45 | 0.64 | 28 | 22 | 1.8 | 32 | 63.2 | 16.9 | 20 | 84 | 450 | 15 | 50 | 20 | 84 | 9.5 | 57.4 | ○ |
| EXAMPLE 15 | 600 | 45 | 0.64 | 28 | 22 | 1.8 | 32 | 63.2 | 16.9 | 20 | 84 | 425 | 60 | 50 | 20 | 84 | 10.8 | 49.7 | ○ |
| COMPARATIVE EXAMPLE 2 | 600 | 45 | 0.64 | 28 | 22 | 1.8 | 32 | 63.2 | 16.9 | 20 | 84 | 400 | 60 | 50 | 20 | 84 | 12.0 | 19.5 | X |
| COMPARATIVE EXAMPLE 3 | 600 | 45 | 0.64 | 28 | 22 | 1.8 | 32 | 63.2 | 16.9 | 20 | 84 | 350 | 60 | 50 | 20 | 84 | 11.5 | 20.4 | X |
| COMPARATIVE EXAMPLE 4 | 600 | 45 | 0.64 | 28 | 22 | 1.8 | 32 | 63.2 | 16.9 | 20 | 84 | 300 | 60 | 50 | 20 | 84 | 11.0 | 21.7 | X |
| COMPARATIVE EXAMPLE 5 | 600 | 45 | 0.64 | 28 | 22 | 1.8 | 32 | 63.2 | 16.9 | 20 | 84 | 250 | 60 | 50 | 20 | 84 | 11.5 | 17.6 | X |
| COMPARATIVE EXAM PLE 6 | 600 | 45 | 0.64 | 28 | 22 | 1.8 | 32 | 63.2 | 16.9 | 20 | 84 | 200 | 60 | 50 | 20 | 84 | 11.5 | 6.7 | X |
| COMPARATIVE EXAMPLE 7 | 600 | 45 | 0.64 | 28 | 22 | 1.8 | 32 | 63.2 | 16.9 | 20 | 84 | 150 | 60 | 50 | 20 | 84 | 11.5 | 8.1 | X |
| COMPARATIVE EXAMPLE 8 | 600 | 45 | 0.64 | 28 | 22 | 1.8 | 32 | 63.2 | 16.9 | 20 | 84 | 100 | 60 | 50 | 20 | 84 | 11.5 | 15.9 | X |

The nitrided steel members were all subjected to the nitriding treatment step under the same condition. That is, the steel member that was heated up to the nitriding treatment temperature of 600° C. in the heating chamber was subjected to nitriding under the condition of the nitriding potential KN=0.64, 600° C., and 45 minutes. Further, a flow rate of $NH_3$ gas was set to 28 liter/min, its partial pressure was set to 32 vol %, a flow rate of $H_2$ gas was set to 22 liter/min, its partial pressure was set to 63.2 vol %, a flow rate of air was set to 1.8 liter/min, and a dew-point temperature in a furnace was set to 16.9° C. Further, after the nitriding was finished, the steel member was loaded into the cooling chamber, the $N_2$ gas at 84 liter/min was introduced thereinto, and cooling of the steel member was performed for 20 minutes. The respective nitrided steel members that had been subjected to the nitriding treatment step under the same condition as above were subjected to the passing step under each of the conditions illustrated in Table 2 (or were not subjected to the passing step).

Incidentally, in the nitriding treatment step, analysis of the partial pressure of $NH_3$ was performed by a "continuous gas analyzer" (manufactured by ABB, model AO2000-Uras26), and analysis of the partial pressure of $H_2$ was performed by a "continuous gas analyzer" (manufactured by ABB, model AO2000-Caldos25).

[Evaluation Method]

1. Measurement of Thickness of the Iron Nitride Compound Layer

Disk-shaped test pieces were cut by a cutting machine, their cross sections were polished by an emery paper, and the polished surfaces were mirror-finished by a buff. After the test pieces were corroded by a 3% nitric acid alcohol, the aforesaid cross sections were observed at 400 magnifications by using a metallurgical (optical) microscope, and the thickness of each of the iron nitride compound layers was measured. The iron nitride compound layer is also called a white layer, and it has a different structure from that of the base metal and appears white, and thus can be easily visually discriminated.

2. Measurement of γ' Fraction

The γ' fraction was measured by an EBSP analysis. For the γ' fraction, an EBSP (Electron Back Scatter diffraction Pattern) device mounted on an FE-SEM (model: JSM7001F manufactured by JEOL) was used. The EBSP method is a method in which a Kikuchi pattern formed by electron back scattering diffraction when an electron beam is emitted to a sample greatly inclined at about 70° in an SEM sample chamber is projected onto a fluorescent screen to be taken in by a television camera, or the like, and indexing of the pattern is performed and a crystal orientation of an emitted point is measured. For the analysis, one obtained by a disk-shaped test piece mirror-polished by a diamond (particle size 1 μm) buff being further finished by polishing using colloidal silica abrasive grains (grain size 0.05 μm) was used. A Phase Map with separated phases based on a crystal structure considered beforehand using analysis software (OIM Analysis) and the obtained pattern was created and the fraction of each of the s and γ' phases in the compound layer was analyzed.

Figure 3:
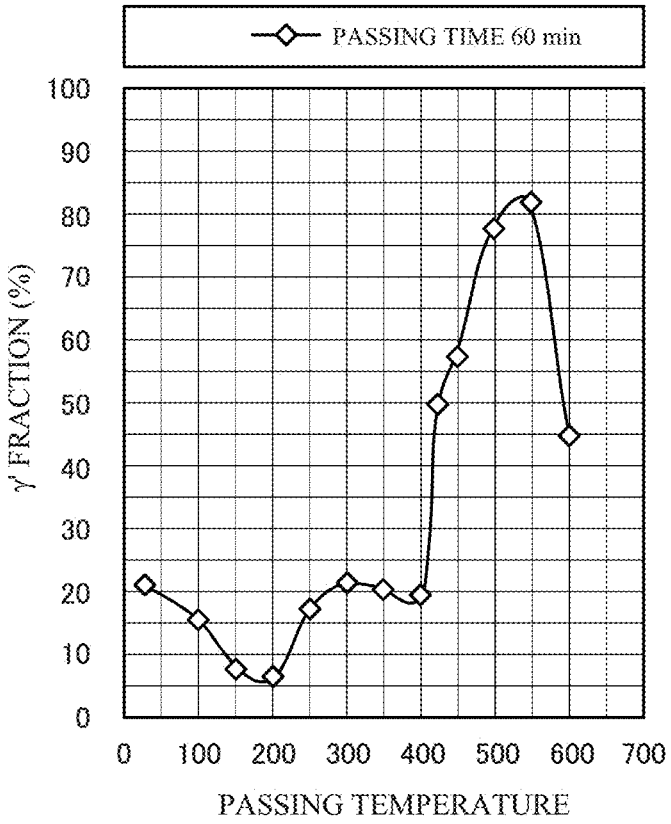
FIG. 3 is a graph illustrating the relationship between a temperature and a γ' fraction in a passing step.
Figure 4:
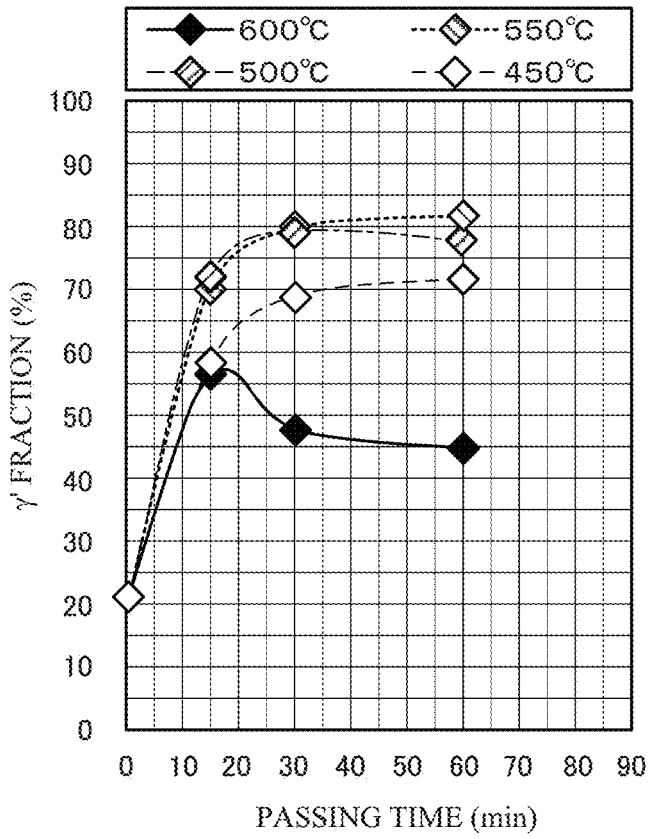
FIG. 4 is a graph illustrating the relationship between a passing time and a γ' fraction.
Figure 5:
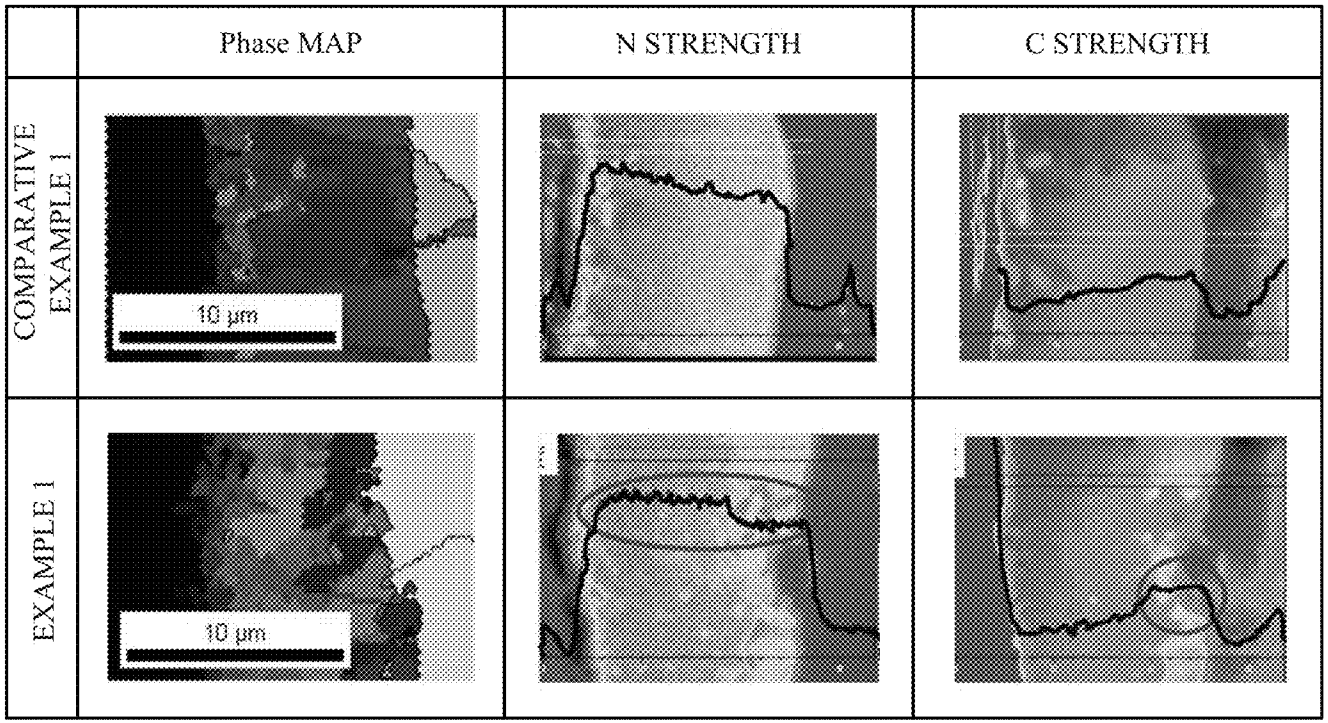
FIG. 5 is a view illustrating a Phase MAP, an N strength, and a C strength of a nitride compound layer of a steel member in Example 1 and Comparative example 1.
Figure 6:
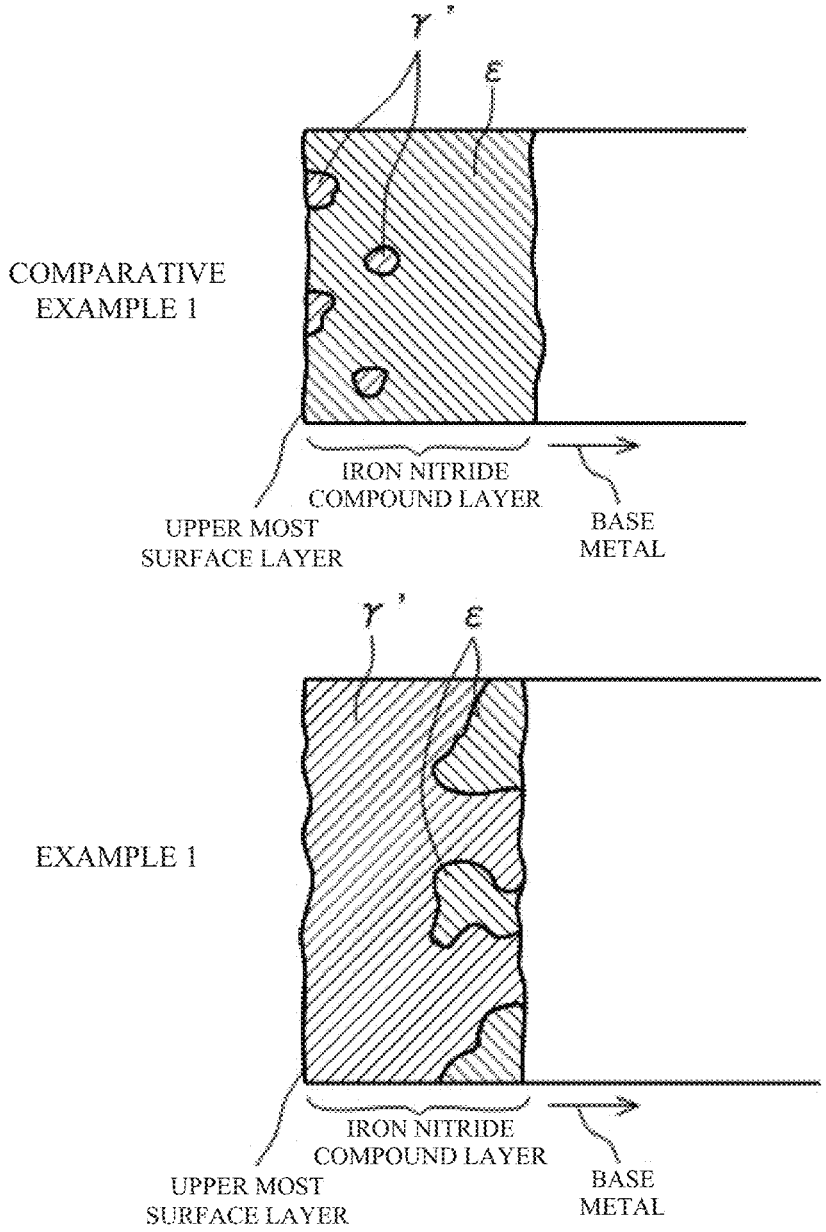
FIG. 6 is a schematic view of the Phase MAPs of the nitride compound layers in FIG. 5.

Determination results of the thickness of the iron nitride compound layer and the γ' phase fraction in the iron nitride compound layer of each of the nitrided steel members are illustrated in Table 2. Incidentally, the determination results were set that the γ' phase fraction of 40% or more is ○, the fraction of 70% or more is ◎, and the fraction of less than 40% or the uppermost surface layer of the nitride compound layer not being the γ' phase is x. Further, the relationship between the temperature and the γ' fraction in the passing step is illustrated in FIG. 3, and the relationship between the passing time and the γ' fraction is illustrated in FIG. 4. Further, the Phase MAP, an N strength, and a C strength of the nitride compound layer in the nitrided steel member falling within the present invention range (Example 1) and the nitrided steel member falling outside the present invention range (Comparative example 1) are illustrated in FIG. 5. Incidentally, the schematic view of the Phase MAPs of the nitride compound layers is illustrated in FIG. 6. The nitrided steel member satisfying the present invention range being the passing step in which the steel member is made to pass through an atmosphere at 425° C. to 600° C. where an iron nitride compound layer does not grow over five minutes or more obtained the γ' phase uppermost surface layer and had the γ' phase fraction of 40% or more. On the other hand, the nitrided steel member that did not satisfy the present invention range had the γ' phase fraction of less than 40%.

Examples 16 to 20, Comparative Examples 9 to 13

Samples (Steel types S35C, S45C, SCM415, SCM420, and SACM645) illustrated in Table 3 were prepared. These samples (Steel types S35C, S45C, SCM415, SCM420, and SACM645) were each subjected to a nitriding treatment step and a passing step under the conditions illustrated in Table 4, to thereby obtain respective nitrided steel members.

TABLE 3

| | □STEEL MATERIAL MAIN ALLOY COMPONENT (COMPONENT MEDIAN VALUE) | | | | | | |
|---|---|---|---|---|---|---|---|
| | C | Mn | Cr | Mo | Al | V | W |
| S35C | 0.35 | 0.75 | | | | | |
| S45C | 0.45 | 0.75 | | | | | |
| SCM415 | 0.15 | 0.73 | 1 | 0.23 | | | |
| SCM420 | 0.2 | 0.73 | 1 | 0.23 | | | |
| SACM645 | 0.45 | 0.3 | 1.5 | 0.23 | 1 | 2 | 6 |

TABLE 4

| | | NITRADING | | | | | | | | |
|---|---|---|---|---|---|---|---|---|---|---|
| | STEEL MATERIAL | TEMPERATURE (° C.) | TIME (min) | KN | NH3 FLOW RATE (L/mn) | H2 FLOW RATE (L/min) | Air FLOW RATE (L/min) | NH3 PARTIAL PRESSURE (vol %) | H2 PARTIAL PRESSURE (vol. %) | DEW POINT (° C.) |
| COMPARATIVE EXAMPLE 9 | S35C | 600 | 90 | 0.68 | 28 | 22 | 1.8 | 33 | 61.5 | 19.2 |
| COMPARATIVE EXAMPLE 10 | S45C | 600 | 90 | 0.68 | 28 | 22 | 1.8 | 33 | 61.5 | 19.2 |

TABLE 4-continued

| | | | | | | | | | | |
|---|---|---|---|---|---|---|---|---|---|---|
| COMPARATIVE EXAMPLE 11 | SCM415 | 600 | 90 | 0.68 | 28 | 22 | 1.8 | 33 | 61.5 | 19.2 |
| COMPARATIVE EXAMPLE 12 | SCM420 | 600 | 90 | 0.68 | 28 | 22 | 1.8 | 33 | 61.5 | 19.2 |
| COMPARATIVE EXAMPLE 13 | SACM645 | 600 | 90 | 0.68 | 28 | 22 | 1.8 | 33 | 61.5 | 19.2 |
| EXAMPLE 16 | S35C | 600 | 90 | 0.68 | 28 | 22 | 1.8 | 33 | 61.5 | 19.2 |
| EXAMPLE 17 | S45C | 600 | 90 | 0.68 | 28 | 22 | 1.8 | 33 | 61.5 | 19.2 |
| EXAMPLE 18 | SCM415 | 600 | 90 | 0.68 | 28 | 22 | 1.8 | 33 | 61.5 | 19.2 |
| EXAMPLE 19 | SCM420 | 600 | 90 | 0.68 | 28 | 22 | 1.8 | 33 | 61.5 | 19.2 |
| EXAMPLE 20 | SACM645 | 600 | 90 | 0.68 | 28 | 22 | 1.8 | 33 | 61.5 | 19.2 |

| | COOLING | | PASSING | | | COOLING | | IRON NITRADE COMPOUND LAYER | | |
|---|---|---|---|---|---|---|---|---|---|---|
| | COOLING TIME (min) | N2 FLOW RATE (L/min) | TEMPERATURE (° C.) | TIME (min) | N2 FLOW RATE (L/min) | COOLING TIME (min) | N2 FLOW RATE (L/min) | THICKNESS (μm) | γ' FRACTION (%) | DETERMINATION |
| COMPARATIVE EXAMPLE 9 | 20 | 84 | — | — | — | 20 | 84 | 13.8 | 26.1 | X |
| COMPARATIVE EXAMPLE 10 | 20 | 84 | — | — | — | 20 | 84 | 15.1 | 7.5 | X |
| COMPARATIVE EXAMPLE 11 | 20 | 84 | — | — | — | 20 | 84 | 15.8 | 0.7 | X |
| COMPARATIVE EXAMPLE 12 | 20 | 84 | — | — | — | 20 | 84 | 16.3 | 1.5 | X |
| COMPARATIVE EXAMPLE 13 | 20 | 84 | — | — | — | 20 | 84 | 10.8 | 31.6 | X |
| EXAMPLE 16 | 20 | 84 | 550 | 45 | 50 | 20 | 84 | 14.1 | 73.1 | ◎ |
| EXAMPLE 17 | 20 | 84 | 550 | 45 | 50 | 20 | 84 | 16.5 | 73.4 | ◎ |
| EXAMPLE 18 | 20 | 84 | 550 | 45 | 50 | 20 | 84 | 15.8 | 47.3 | ○ |
| EXAMPLE 19 | 20 | 84 | 550 | 45 | 50 | 20 | 84 | 16.1 | 44.9 | ○ |
| EXAMPLE 20 | 20 | 84 | 550 | 45 | 50 | 20 | 84 | 11.5 | 50.7 | ○ |

The nitrided steel members were all subjected to the nitriding treatment step under the same condition. That is, the steel member that was heated up to the nitriding treatment temperature of 600° C. in the heating chamber was subjected to nitriding under the condition of the nitriding potential KN=0.68, 600° C., and 90 minutes. Further, a flow rate of $NH_3$ gas was set to 28 liter/min, its partial pressure was set to 33 vol %, a flow rate of $H_2$ gas was set to 22 liter/min, its partial pressure was set to 61.5 vol %, a flow rate of air was set to 1.8 liter/min, and a dew-point temperature in a furnace was set to 19.2° C. Further, after the nitriding was finished, the steel member was loaded into the cooling chamber, the $N_2$ gas at 84 liter/min was introduced thereinto, and cooling of the steel member was performed for 20 minutes. The respective nitrided steel members that had been subjected to the nitriding treatment step under the same condition as above were subjected to the passing step under each of the conditions illustrated in Table 4 (or were not subjected to the passing step). Determination results of the thickness of the iron nitride compound layer and the γ' phase fraction in the iron nitride compound layer of each of the nitrided steel members are illustrated in Table 4.

Examples 21 to 25, Comparative Examples 14 to 18

Samples (Steel types S35C, S45C, SCM415, SCM420, and SCM435) illustrated in Table 5 were prepared. These samples (Steel types S35C, S45C, SCM415, SCM420, and SCM435) were each subjected to a nitriding treatment step and a passing step under the conditions illustrated in Table 6, to thereby obtain respective nitrided steel members.

TABLE 5

| | □STEEL MATERIAL MAIN ALLOY COMPONENT (COMPONENT MEDIAN VALUE) | | | | | | |
|---|---|---|---|---|---|---|---|
| | C | Mn | Cr | Mo | Al | V | W |
| S35C | 0.35 | 0.75 | | | | | |
| S45C | 0.45 | 0.75 | | | | | |
| SCM415 | 0.15 | 0.73 | 1 | 0.23 | | | |
| SCM420 | 0.2 | 0.73 | 1 | 0.23 | | | |
| SCM435 | 0.35 | 0.73 | 1 | 0.23 | | | |

TABLE 6

| | | NITRIDING | | | | | | | | |
|---|---|---|---|---|---|---|---|---|---|---|
| | STEEL MATERIAL | TEMPERATURE (° C.) | TIME (min) | KN | NH3 FLOW RATE (L/mn) | H2 FLOW RATE (L/min) | Air FLOW RATE (L/min) | NH3 PARTIAL PRESSURE (vol %) | H2 PARTIAL PRESSURE (vol. %) | DEW POINT (° C.) |
| COMPARATIVE EXAMPLE 14 | S35C | 600 | 45 | 0.68 | 28 | 22 | 1.8 | 33 | 61.5 | 19.2 |
| COMPARATIVE EXAMPLE 15 | S45C | 600 | 45 | 0.68 | 28 | 22 | 1.8 | 33 | 61.5 | 19.2 |

TABLE 6-continued

| | | | | | | | | | | |
|---|---|---|---|---|---|---|---|---|---|---|
| COMPARATIVE EXAMPLE 16 | SCM415 | 600 | 45 | 0.68 | 28 | 22 | 1.8 | 33 | 61.5 | 19.2 |
| COMPARATIVE EXAMPLE 17 | SCM420 | 600 | 45 | 0.68 | 28 | 22 | 1.8 | 33 | 61.5 | 19.2 |
| COMPARATIVE EXAMPLE 18 | SCM435 | 600 | 45 | 0.68 | 28 | 22 | 1.8 | 33 | 61.5 | 19.2 |
| EXAMPLE 21 | S35C | 600 | 45 | 0.68 | 28 | 22 | 1.8 | 33 | 61.5 | 19.2 |
| EXAMPLE 22 | S45C | 600 | 45 | 0.68 | 28 | 22 | 1.8 | 33 | 61.5 | 19.2 |
| EXAMPLE 23 | SCM415 | 600 | 45 | 0.68 | 28 | 22 | 1.8 | 33 | 61.5 | 19.2 |
| EXAMPLE 24 | SCM420 | 600 | 45 | 0.68 | 28 | 22 | 1.8 | 33 | 61.5 | 19.2 |
| EXAMPLE 25 | SCM435 | 600 | 45 | 0.68 | 28 | 22 | 1.8 | 33 | 61.5 | 19.2 |

| | COOLING | | PASSING | | | COOLING | | IRON NITRADE COMPOUND LAYER | | |
|---|---|---|---|---|---|---|---|---|---|---|
| | COOLING TIME (min) | N2 FLOW RATE (L/min) | TEMPERATURE (° C.) | TIME (min) | N2 FLOW RATE (L/min) | COOLING TIME (min) | N2 FLOW RATE (L/min) | THICKNESS (μm) | γ' FRACTION (%) | DETERMINATION |
| COMPARATIVE EXAMPLE 14 | 20 | 84 | — | — | — | 20 | 84 | 7.2 | 22.2 | X |
| COMPARATIVE EXAMPLE 15 | 20 | 84 | — | — | — | 20 | 84 | 9.0 | 30.0 | X |
| COMPARATIVE EXAMPLE 16 | 20 | 84 | — | — | — | 20 | 84 | 11.3 | 0.9 | X |
| COMPARATIVE EXAMPLE 17 | 20 | 84 | — | — | — | 20 | 84 | 11.5 | 8.3 | X |
| COMPARATIVE EXAMPLE 18 | 20 | 84 | — | — | — | 20 | 84 | 10.3 | 0.0 | X |
| EXAMPLE 21 | 20 | 84 | 550 | 45 | 50 | 20 | 84 | 7.8 | 91.1 | ◎ |
| EXAMPLE 22 | 20 | 84 | 550 | 45 | 50 | 20 | 84 | 8.0 | 86.9 | ◎ |
| EXAMPLE 23 | 20 | 84 | 550 | 45 | 50 | 20 | 84 | 11.5 | 81.3 | ◎ |
| EXAMPLE 24 | 20 | 84 | 550 | 45 | 50 | 20 | 84 | 12.8 | 50.9 | ○ |
| EXAMPLE 25 | 20 | 84 | 550 | 45 | 50 | 20 | 84 | 10.8 | 47.7 | ○ |

The nitrided steel members were all subjected to the nitriding treatment step under the same condition. That is, the steel member that was heated up to the nitriding treatment temperature of 600° C. in the heating chamber was subjected to nitriding under the condition of the nitriding potential KN=0.68, 600° C., and 45 minutes. Further, a flow rate of $NH_3$ gas was set to 28 liter/min, its partial pressure was set to 33 vol %, a flow rate of $H_2$ gas was set to 22 liter/min, its partial pressure was set to 61.5 vol %, a flow rate of air was set to 1.8 liter/min, and a dew-point temperature in a furnace was set to 19.2° C. Further, after the nitriding was finished, the steel member was loaded into the cooling chamber, the $N_2$ gas at 84 liter/min was introduced thereinto, and cooling of the steel member was performed for 20 minutes. The respective nitrided steel members that had been subjected to the nitriding treatment step under the same condition as above were subjected to the passing step under each of the conditions illustrated in Table 6 (or were not subjected to the passing step). Determination results of thickness CL of the iron nitride compound layer and the γ' phase fraction in the iron nitride compound layer of each of the nitrided steel members are illustrated in Table 6.

Examples 26 to 33, Comparative Examples 19 to 22

Samples (Steel type HSRG2) illustrated in Table 7 were prepared. These samples (Steel type HSRG2) were each subjected to a nitriding treatment step and a passing step under the conditions illustrated in Table 8, to thereby obtain respective nitrided steel members.

TABLE 7

| STEEL MATERIAL | C | Si | Mn | P | S | Cr | Mo | Fe |
|---|---|---|---|---|---|---|---|---|
| HSRG2 | 0.095 | 0.2 | 0.9 | | | 1.4 | | BALANCE |

TABLE 8

| | NITRIDING | | | | | | | | |
|---|---|---|---|---|---|---|---|---|---|
| | TEMPERATURE (° C.) | TIME (min) | KN | NH3 FLOW RATE (L/mn) | H2 FLOW RATE (L/min) | Air FLOW RATE (L/min) | NH3 PARTIAL PRESSURE (vol %) | H2 PARTIAL PRESSURE (vol. %) | DEW POINT (° C.) |
| COMPARATIVE EXAMPLE 19 | 600 | 45 | 1.24 | 40 | 10 | 1.8 | 44 | 50 | 18.2 |
| EXAMPLE 26 | 600 | 45 | 1.24 | 40 | 10 | 1.8 | 44 | 50 | 18.2 |
| COMPARATIVE EXAMPLE 20 | 600 | 45 | 1.04 | 36 | 14 | 1.8 | 40 | 53 | 18.2 |
| EXAMPLE 27 | 600 | 45 | 1.04 | 36 | 14 | 1.8 | 40 | 53 | 18.2 |
| COMPARATIVE EXAMPLE 21 | 600 | 45 | 0.84 | 32 | 18 | 1.8 | 36 | 57 | 18.2 |

TABLE 8-continued

| | | | | | | | | | |
|---|---|---|---|---|---|---|---|---|---|
| EXAMPLE 28 | 600 | 45 | 0.84 | 32 | 18 | 1.8 | 36 | 57 | 18.2 |
| EXAMPLE 29 | 600 | 120 | 0.229 | 10 | 40 | 1.8 | 17.1 | 82.3 | 17.1 |
| EXAMPLE 30 | 600 | 120 | 0.362 | 14 | 36 | 1.5 | 23.5 | 75 | 13.1 |
| EXAMPLE 31 | 600 | 120 | 0.45 | 16 | 34 | 2 | 27.1 | 71.6 | 14.8 |
| EXAMPLE 32 | 600 | 120 | 0.55 | 19 | 31 | 2 | 30.1 | 67.9 | 14.2 |
| EXAMPLE 33 | 600 | 45 | 0.65 | 28 | 22 | 1.8 | 32 | 63.2 | 16.9 |
| COMPARATIVE EXAMPLE 22 | 600 | 45 | 0.65 | 28 | 22 | 1.8 | 32 | 63.2 | 16.9 |

| | COOLING | | PASSING | | | | | | |
|---|---|---|---|---|---|---|---|---|---|
| | COOLING TIME (min) | N2 FLOW RATE (L/min) | TEMPERATURE (° C.) | TIME (min) | N2 FLOW RATE (L/min) | KN | NH3 FLOW RATE (L/mn) | H2 FLOW RATE (L/min) | Air FLOW RATE (L/min) |
| COMPARATIVE EXAMPLE 19 | 20 | 84 | — | — | — | — | — | — | — |
| EXAMPLE 26 | 20 | 84 | 550 | 60 | 50 | — | — | — | — |
| COMPARATIVE EXAMPLE 20 | 20 | 84 | — | — | — | — | — | — | — |
| EXAMPLE 27 | 20 | 84 | 550 | 60 | 50 | — | — | — | — |
| COMPARATIVE EXAMPLE 21 | 20 | 84 | — | — | — | — | — | — | — |
| EXAMPLE 28 | 20 | 84 | 550 | 60 | 50 | — | — | — | — |
| EXAMPLE 29 | 20 | 84 | 525 | 30 | 50 | — | — | — | — |
| EXAMPLE 30 | 20 | 84 | 525 | 30 | 50 | — | — | — | — |
| EXAMPLE 31 | 20 | 84 | 525 | 30 | 50 | — | — | — | — |
| EXAMPLE 32 | 20 | 84 | 525 | 30 | 50 | — | — | — | — |
| EXAMPLE 33 | 20 | 84 | 525 | 45 | — | 0.15 | 5 | 45 | 2 |
| COMPARATIVE EXAMPLE 22 | 20 | 84 | 525 | 45 | — | 2.50 | 33 | 17 | 1.5 |

| | PASSING | | | COOLING | | IRON NITRADE COMPOUND LAYER | | |
|---|---|---|---|---|---|---|---|---|
| | NH3 PARTIAL PRESSURE (vol %) | H2 PARTIAL PRESSURE (vol. %) | DEW POINT (° C.) | COOLING TIME (min) | N2 FLOW RATE (L/min) | THICKNESS (μm) | γ' FRACTION (%) | DETERMINATION |
| COMPARATIVE EXAMPLE 19 | — | — | — | — | — | 12.0 | 2.2 | |
| EXAMPLE 26 | — | — | — | 20 | 84 | 11.5 | 61.9 | ○ |
| COMPARATIVE EXAMPLE 20 | — | — | — | — | — | 13.5 | 2.1 | |
| EXAMPLE 27 | — | — | — | 20 | 84 | 10.0 | 81.8 | ○ |
| COMPARATIVE EXAMPLE 21 | — | — | — | 20 | 84 | 13.5 | 8.1 | |
| EXAMPLE 28 | — | — | — | 20 | 84 | 11.0 | 72.2 | ○ |
| EXAMPLE 29 | — | — | — | 20 | 84 | 2.0 | 98.9 | ○ |
| EXAMPLE 30 | — | — | — | 20 | 84 | 10.0 | 76.0 | ○ |
| EXAMPLE 31 | — | — | — | 20 | 84 | 12.5 | 81.6 | ○ |
| EXAMPLE 32 | — | — | — | 20 | 84 | 13.5 | 73.2 | ○ |
| EXAMPLE 33 | 12 | 87.8 | 10.25 | 20 | 84 | 9.0 | 91.7 | ○ |
| COMPARATIVE EXAMPLE 22 | 60 | 41.3 | 13.6 | 20 | 84 | 10.5 | 52.0 | ×ε PHASE UPPERMOST SURFACE LAYER |

The condition of the nitriding treatment step was changed within a range of the nitriding treatment temperature: 600° C., the nitriding treatment time: 45 to 120 minutes, the nitriding potential KN: 0.229 to 1.24, the $NH_3$ gas flow rate: 10 to 40 liter/min, the $NH_3$ gas partial pressure: 17.1 to 44 vol %, the $H_2$ gas flow rate: 10 to 40 liter/min, the $H_2$ gas partial pressure: 50 to 82.3 vol %, the air flow rate: 1.5 to 2 liter/min, and the dew-point temperature in a furnace: 13.1 to 18.2° C. Further, after the nitriding was finished, the steel member was loaded into the cooling chamber, the $N_2$ gas at 84 liter/min was introduced thereinto, and cooling of the steel member was performed for 20 minutes. The respective nitrided steel members that had been subjected to the nitriding treatment step under the same condition as above were subjected to the passing step under each of the conditions illustrated in Table 8 (or were not subjected to the passing step). Determination results of the thickness CL of the iron nitride compound layer and the γ' phase fraction in the nitride compound layer of each of the nitrided steel members are illustrated in Table 8. Comparative example 22 was evaluated as "x" because the uppermost surface layer was the ε phase.

INDUSTRIAL APPLICABILITY

The present invention is useful for the nitriding technique of steel.

EXPLANATION OF CODES

1 heat treatment apparatus
11 loading part

11 cooling chamber
12 heating chamber
15 conveyor
20 case
21 door
22 hood
25 heater
26, 27 fan

The invention claimed is:

1. A nitriding treatment method of a steel member, the method comprising:

subjecting the steel member to a nitriding treatment in a nitriding gas atmosphere, the nitriding gas atmosphere having:

a temperature of 550° C. to 610° C.; and a nitriding potential with which a γ' phase or ε phase iron nitride compound layer is generated on a surface of the steel member, in the nitriding treatment, a nitriding time is greater than 0.5 hours and less than 10 hours, and then, passing the steel member through an atmosphere in which the iron nitride compound layer does not grow, the temperature of the atmosphere being within a range of 425° C. to 550° C. during the passing, wherein a duration of the passing is for five minutes or more, wherein, after the passing, the iron nitride compound layer has a γ' phase uppermost surface layer, and γ' phase fraction present in the iron nitride compound layer is 40% or more.

2. The nitriding treatment method of the steel member according to claim 1, wherein the nitriding potential of the nitriding gas atmosphere in the nitriding treatment is 0.25 or more.

3. The nitriding treatment method of the steel member according to claim 1, wherein the atmosphere in which the iron nitride compound layer does not grow is a nitrogen-containing atmosphere within a range of 450° C. to 5550° C.

4. The nitriding treatment method of the steel member according to claim 1, wherein the atmosphere in which the iron nitride compound layer does not grow is an atmosphere containing one or more of nitrogen, Ar, and $H_2$.

5. The nitriding treatment method of the steel member according to claim 1, wherein the atmosphere in which the iron nitride compound layer does not grow is a nitridation gas atmosphere having a nitriding potential with which the γ' phase or ε phase iron nitride compound layer is not further generated.

* * * * *